US006171667B1

(12) United States Patent
Kostic

(10) Patent No.: US 6,171,667 B1
(45) Date of Patent: Jan. 9, 2001

(54) LIFELIKE AQUATIC ANIMAL REPLICA

(76) Inventor: David C. Kostic, 9797 S. Dampler Way, Highlands Ranch, CO (US) 80126

( * ) Notice: Under 35 U.S.C. 154(b), the term of this patent shall be extended for 0 days.

(21) Appl. No.: 09/061,736

(22) Filed: Apr. 19, 1998

Related U.S. Application Data

(63) Continuation-in-part of application No. 09/061,532, filed on Apr. 15, 1998, now Pat. No. 5,981,004.

(51) Int. Cl.[7] ..... G09F 19/00
(52) U.S. Cl. ..... 428/16
(58) Field of Search ..... 428/16, 68; D11/117, D11/131–136; 119/253, 256; 434/296

(56) References Cited

U.S. PATENT DOCUMENTS 3,186,120 * 6/1965 Layson ..... 428/16
3,271,897 * 9/1966 Gelinas ..... 428/16
4,588,618 * 5/1986 Wolfe ..... 428/16
5,301,444 * 4/1994 Horiuchi ..... 40/426
5,981,004 * 11/1999 Kostic ..... 428/16

* cited by examiner

*Primary Examiner*—Margaret Medley
(74) *Attorney, Agent, or Firm*—Lee G. Meyer; Snell & Wilmer, LLP

(57) ABSTRACT

A replica of a fish or other aquatic animal, capable of placement into indoor and outdoor fish ponds, with or without fountain current flow, with no overhanging or suspension member provided. An aquatic or marine animal replica, and preferably a Koi fish, is tethered to an anchor or the bottom of the pond to provide lifelike movement to the replica submerged in the pond water. In one aspect the replica is flexible to simulate swimming movement in a current. In another aspect the buoyancy of the device can be manipulated for depth placement.

13 Claims, 1 Drawing Sheet

LIFELIKE AQUATIC ANIMAL REPLICA

The present application is a Continuation-in-Part of application Ser. No. 09/061,532, filed Apr. 15, 1998 now U.S. Pat. No. 5,981,004, for Decorative Aquatic Animal Replica Device. The parent application, which is incorporated herein, by reference, in its entirety, discloses an aquatic or marine animal replica, and preferably a Koi fish, supported on an adjustable rod which supportedly communicates with a stand member having a reservoir therein to accept a clear ballasting liquid.

BACKGROUND OF THE INVENTION

1. Field of the Invention

This invention relates to aquatic and marine lifelike replication display devices and more specifically to artificial devices that simulate aquatic animals for use in indoor and outdoor water features such as decorative ponds, fountains, and the like.

2. Related Art

Fishes and aquatic life, especially tropical aquatic life have long been cultivated by man in aquariums. These aquariums can be from the size slightly bigger than a fish bowl to large, million gallon habitations occupying many square feet and even whole rooms. It has long been recognized that an aquarium can not only be decorative but relaxing, giving the viewer a sense of peacefulness and tranquility.

One type of aquarium is a "fish pond". It has long been accepted that it is a possession of beauty and even prestige to have a water feature such as an indoor or outdoor fish pond or fountain. The ancients in fact bred a specific breed of fish called a Koi, which resembles a large goldfish, to populate these ponds. These water features can contain fountains or the like and be architecturally placed into the structure of, for example, a building or a home. One popular placement is in commercial atriums or domestic outdoor fountains.

Although the aquatic life that populate these ponds are beautiful, they are difficult to maintain. As live animals, their environment must be regulated constantly to provide life supporting surroundings. These fish, and especially Koi fish, are extremely expensive with those of a size about that of a large trout running over $3,000. In colder climes where temperatures dip even in the warmer months, it is very difficult to maintain temperatures in these ponds to allow these aquatic life to survive. These fish, of course, have to be maintained and fed on a regular basis adding to the expense. These ponds tend to have other problems relating to fungi, bacteria, algae and the like which make maintaining the ponds with the live animals, and especially Koi, particularly difficult. This is especially true with fountains and other water pumping devices which are particularly sensitive to algae and other bacterial buildup. For example, one treatment for algae or bacterial buildup is to pour household bleach or chlorine into the water to kill the algae. This of course will also kill fish, if they are present.

There has been much attempted in the prior art to obtain the aesthetic aspects of having these beautiful aquatic animals present, yet not having the live animals. Various strings and ropes and other kinds of devices have been devised to mask the fact that the animals are, in fact, artificial. The problem with using strings or other kind of suspension devices in outdoor and indoor ponds, is that there is no wall to support the suspension devices. For example, U.S. Pat. Nos. 4,588,618, D-294,129 and D-287,110 teach artificial fish suspended to make it look like fish are in the water. U.S. Pat. Nos. 4,550,518 and 3,186,120 teach fish decoys that give the illusion that fish are in the water. U.S. Pat. Nos. 3,975,845; D-327,142; D-289,023; and D-289,022 disclose artificial fish.

Many of the prior art devices employ suspension media that are visible or do not allow the adjustment of the device in the water feature. Thus, it would be advantageous to have an aquatic animal which was able to be placed in substantially any water feature or pond, irrespective of the water flow and currents, yet move in a life like manner without the appearance of the supporting member to the naked eye, but without the requirement for suspension of the aquatic animal on overhanging members, walls or the like.

SUMMARY OF THE INVENTION

It is now been discovered that an artificial replica of a fish or other aquatic animal which is capable of movement in a life like manner and is capable of placement into indoor and outdoor water features, with or without fountain current flow, with no overhanging or suspension member. In accordance with the invention, a device having a substantially neutral buoyancy comprises an aquatic or marine animal replica, and preferably a Koi fish, tethered on a substantially invisible connector which is weighted or anchored to maintain upright orientation of the replica. In one aspect, the replica is tethered to an anchor secured to the bottom of the water feature. In another aspect, the device is tethered to a weight such that the device is substantially of neutral buoyancy enabling the device to float beneath the surface of the water such that the device moves in the current to simulate a live animal. In another embodiment, the replica is flexible to simulate a swimming motion in the current.

The anchor can be of any shape and is preferably clear or of the same color as the bottom of the pond. In one embodiment the clear anchor has a reservoir therein to accept a clear ballasting liquid to adjust buoyancy. In another embodiment the replica contains a reservoir therein to accept a clear ballasting liquid to adjust buoyancy.

DETAILED DESCRIPTION OF THE DRAWING

Figure 1:
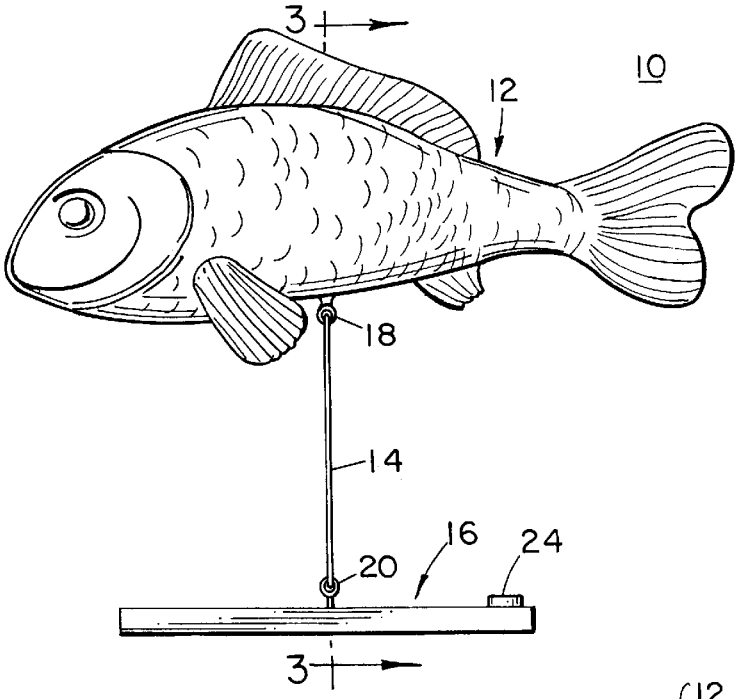
FIG. 1 is a side perspective view of a Koi fish tethered on an anchor in accordance with the instant invention.

FIG. 1 shows the decorative, life like aquatic animal replica device for placement in a fish pond or the like in accordance with the instant invention. An aquatic replica device 10 has an aquatic animal replica 12, is secured to a tether 14 which is in turn secured to an anchor 16. Preferably the material of the tether 14 and the anchor 16 is clear or the color of the bottom of the pond (not shown), to avoid detection when the aquatic replica device 10 is placed into a pond, fountain or the like.

Figure 5:
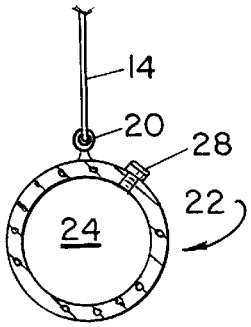
FIG. 5 is a cross sectional view of another anchor that can be used in accordance with the invention.

The tether 14, is preferably of a monofilament construction in the style of clear fishing line or the like, and is attached to the aquatic animal replica 12 on one end by means of eyelet 18 and to anchor 16 on the other, by means of eyelet 20. As better seen in FIG. 3, the eyelets 18 and 20 are secured to aquatic animal replica 12 and anchor 16, respectively, by rivets or threaded fasteners which form a water tight/air tight seal. As better seen in FIG. 5, the anchor may be of a spherical shape when the "wandering" aspect of the aquatic replica device 10 is desired. As shown in FIG. 5, the tether 14 is secured to a spherical anchor 22 having a fillable cavity 24*a* there within, by means of eyelet 20. In this embodiment, the aquatic replica device 10 has a slightly negative buoyancy and tend to sink, such that the spherical anchor 22 barely touches or remains very proximate the bottom of the pond. In this manner the anchor will allow the aquatic replica device 10 to "wander" with the current, simulating a life like effect to the aquatic replica device 10. When the spherical anchor 22 does contact the bottom of the pond, because it is spherical shape, only one point contacts the bottom surface of the pond, minimizing drag.

Figure 3:
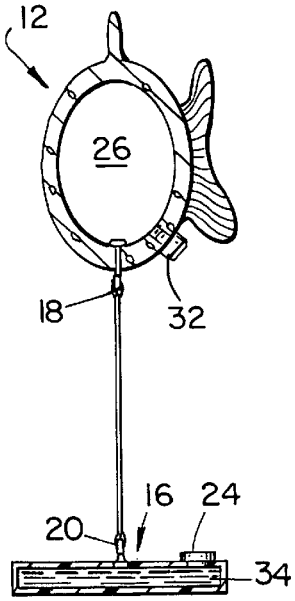
FIG. 3 is a cross section through lines 3—3 of FIG. 1 showing the ballast chamber within the anchor.

Anchor 16 and spherical anchor 22 contain a capped, fill spout 24 and fill spout 28 through which cavity 34 and cavity 24*a* are filled respectively, with a ballasting fluid. As better shown in FIG. 3, the cavity 34 is preferably substantially the total volume of anchor 16. As shown in FIG. 3, the aquatic animal replica 12 has a cavity 26 and a fill cap 32 adapted to accept a ballasting material in accordance with manipulating the buoyancy of both the aquatic animal replica 12 and the aquatic replica device 10.

Figure 2:
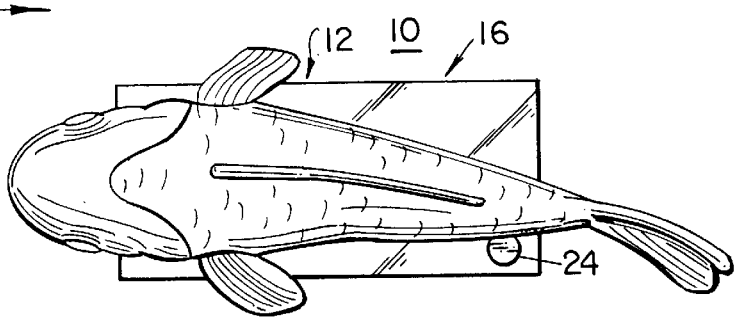
FIG. 2 is a top, perspective view of the fish in FIG. 1.

As better shown in FIG. 2, the aquatic animal replica 12 substantially hovers over the center of the anchor 16 and anchor 16 is preferably rectangular when a static placement is desired to increase drag of the anchor and the bottom of the pond. It will be realized that the tether configuration of the instant invention not only keeps the replica righted, but allows placement and regulates movement of the aquatic replica device 10.

As shown in FIG. 3, in operation the tether 14 is inserted into eyelet 18 on one end and tied off. The tether 14 is then sized for depth and the other end tied through eyelet 20. Filler spout 24 and/or fill cap 32, is removed and a ballasting material poured into the cavity 26 and/or cavity 34 within aquatic animal replica 12 or the anchor 16. The filler spout 24 and/or fill cap 32 are then replaced. The liquid ballast material preferably used in the anchor 16 or spherical anchor 22, which is preferably clear or light blue or of a color that is the same as the bottom of the pond, has a specific gravity that is slightly greater than water i.e. greater than 1, to off set the positive buoyancy of the aquatic animal replica 12 and act as a righting ballast.

Figure 4:
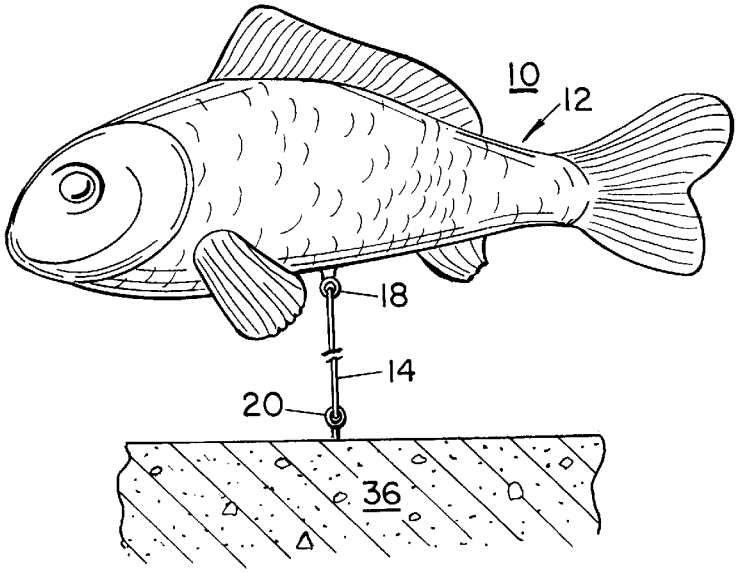
FIG. 4 is a side perspective view of a Koi fish tethered to an eyelet permanently secured to the bottom of the pond.

In accordance with another aspect of the invention, as shown in FIG. 4, the aquatic replica device 10 can be tethered to the bottom of the pond or water feature 36. Turning to FIG. 4, there is shown the aquatic animal replica 12 with eyelet 18 attached to one end of tether 14 with the other end of tether 14 attached to eyelet 20 secured to the bottom of a pond or water feature 36. In this manner the replica 12 is mobile about the tether but stationary with regard to placement within the water feature.

In accordance with the invention, the replica can be formed of an appropriate material to present an esthetically pleasing figure. Preferably, the replica is hollow (as shown in FIG. 3 to allow adjustment of buoyancy. In another embodiment the anchor can be solid depending upon the buoyancy of the aquatic replica device 10.

The aquatic animal replica 12 is preferably of a flexible material, especially along the aft body to simulate the movement of for example, a live fish. The point of attachment of the tether 14 to the aquatic animal replica 12, i.e. fore or aft, will also effect the movement of the device as well as the movement of the aquatic animal replica 12 about the tether 14.

What is claimed is:

1. A life like, substantially neutrally buoyant artificial aquatic animal replica device comprising:

a.) an aquatic animal replica having a substantially positive buoyancy; and b.) a tether means communicating with said replica on one end and either the bottom of a water filled vessel in which the aquatic replica is placed or an anchor means having a buoyancy slightly less than said replica on the other end.

2. The device of claim 1 further comprising means for adjusting the buoyancy of the device.

3. The device of claim 1 further comprising a reservoir in said anchor to accept a non discernable liquid to adjust the buoyancy of said device.

4. The device of claim 1 further comprising a reservoir in said replica to accept a ballast material to adjust the buoyancy of said device.

5. The device of claim 1 wherein said replica is flexible.

6. The device of claim 1 wherein said aquatic animal replica is a Koi fish.

7. The device of claim 1 wherein said tether is of a monofilament, opaque material.

8. A life like, substantially neutrally buoyant artificial aquatic animal replica device for submerged use in a water feature comprising:

a.) an aquatic animal replica having a substantially positive buoyancy and having means for varying the buoyancy of said replica;

b.) an anchor means having a buoyancy slightly less than said replica and having means for varying the buoyancy of said anchor means; and c.) a tether means secured to said replica on one end and said anchor means on the other.

9. The device of claim 8 wherein said replica is flexible.

10. The device of claim 8 wherein said aquatic animal replica is a Koi fish.

11. The device of claim 8 wherein said tether is of a monofilament, opaque material.

12. The device of claim 8 wherein said replica contains a fillable reservoir therein.

13. The device of claim 8 wherein said anchor contains a fillable reservoir therein.

* * * * *